US005967103A

United States Patent [19]

Kuperman

[11] Patent Number: 5,967,103

[45] Date of Patent: Oct. 19, 1999

[54] THREE-CYCLE STROKE TWO INTERNAL COMBUSTION ENGINE

[76] Inventor: Aryeh Kuperman, 15/3 Havradim Street Ramot Yitzhak 36781, Nesher, Israel

[21] Appl. No.: 09/056,660

[22] Filed: Apr. 8, 1998

[51] Int. Cl.[6] ..... F02B 33/06

[52] U.S. Cl. ..... 123/61 R

[58] Field of Search ..... 123/61 R, 52.5

[56] References Cited

U.S. PATENT DOCUMENTS

| | | | |
|---|---|---|---|
| 676,523 | 6/1901 | Wood | 123/61 R |
| 3,385,656 | 5/1968 | Panhard | 123/61 R |
| 4,407,240 | 10/1983 | Fromson | 123/61 R |
| 4,414,927 | 11/1983 | Simon | 123/61 R |
| 4,913,100 | 4/1990 | Eickmann | 123/61 R |
| 5,285,752 | 2/1994 | Reed et al. | 123/61 R |
| 5,676,097 | 10/1997 | Montresor | 123/61 R |

*Primary Examiner*—Marguerite McMahon
*Attorney, Agent, or Firm*—Edward Langer, Pat. Atty.

[57] ABSTRACT

A three cycle, two-stroke internal combustion engine from which work can be extracted in two directions. In the preferred embodiment, the inventive two-stroke engine is constructed as a cylinder having a reciprocating piston slidably seated therein, with the piston defining a compression and combustion chamber between the cylinder wall and each side of the piston. The two-stroke engine can provide work in bi-directional fashion from the two combustion chambers acting in phase. A piston rod is provided with reciprocating linear motion, and a mechanical converter is used to change the linear movement to rotational motion providing torque from which rotational power can be extracted for machinery. In an alternative embodiment, the cylinder is shaped with a bottom portion which is split into two sections, in which a bifurcated piston is seated in reciprocating fashion. A piston rod extending through the space between the split cylinder sections is driven with conventional side-to-side linear motion, and is connected to a conventional offset crankshaft, to harness the useful work output of the engine. The two-stroke engine is compact in size and more powerful than a similar 4 or 2-cycle engine, since its dual action makes it equivalent to two combined standard engines. The engine also provides a reduction in overall weight, decreasing the weight-to-power ratio, with an increase in fuel efficiency. Recoil impulses from the torque produced are reduced, increasing the engine life.

16 Claims, 11 Drawing Sheets

THREE-CYCLE STROKE TWO INTERNAL COMBUSTION ENGINE

FIELD OF THE INVENTION

The present invention relates to the operating cycles of internal combustion engines and the like, and more particularly, to a three-cycle internal combustion engine from which work can be extracted in two directions of one piston.

BACKGROUND OF THE INVENTION

There are known prior art engine designs featuring a two-stroke internal combustion engine, including those described in U.S. Pat. Nos. 3,283,752 and 4,385,597 to Stelzer, No. 4,831,972 to Barnwell, No. 5,036,667 to Thatcher, and No. 5,285,752 to Reed et al. The Reed patent features rotary valves for fresh air intake, and this requires conversion of the linear piston motion to rotary motion, introducing additional friction. The Thatcher patent returns a portion of the power developed to force return of the combustion piston motion, decreasing output.

The Barnwell patent and the Stelzer patents feature extremely long piston rods, a portion of which are exposed beyond the cylinder, making them vulnerable to more-than-usual wear due to friction on entering and exiting the reaction chamber at each stroke. Leaking of fuel across the entry/exit barrier can occur as well as pressure gradients causing "bubbles" which can "choke" the engine at worst, or reduce Its efficiency at best. Thus, the exposed extra-long piston rods of the previous designs act as weak points, reducing the overall strength of the engine.

In the Steizer design, the single operating cycle does not allow for full exhaust of combustion gases, and there is a mixture of burnt gas and the fresh fuel supply, which reduces efficiency. As mentioned above, a portion of the piston is exposed beyond the cylinder, and the O-ring used to seal the piston exits and returns into the cylinder with each cycle, causing a shock against the O-ring on each re-insertion.

An additional weakness of the previous designs is the connection between the piston rod and the crankshaft. The above designs do not permit direct connection with the conventional type of crankshaft, so this involves additional loss of efficiency for the engine.

The prior art two-stroke internal combustion engine designs, therefore, suffered from intrinsic flaws detrimental to their sturdiness and efficiency, and represented radical departures from the standard practice. This made their adaptation to the existing market difficult.

In addition, the prior art designs do not allow for operation as a Diesel engine, requiring high compression ratios.

Therefore, it would be desirable to overcome the disadvantages associated with the prior art designs, and provide a sturdy, lightweight internal combustion engine providing increased efficiency.

SUMMARY OF THE INVENTION

Accordingly, it is a principal object of the invention to overcome the above-mentioned disadvantages of prior art engine designs and provide a three cycle, two-stroke internal combustion engine from which work can be extracted in two directions.

In accordance with a preferred embodiment of the present invention, there is provided a three cycle, two-stroke internal combustion engine comprising:

a cylinder means having interior volume defined by wall means having a portion thereof projecting longitudinally from one end of said cylinder into said Interior volume, defining a cavity external to said cylinder means proximate said wall means portion;

a piston means slidable in reciprocating fashion and sealed within said cylinder means and having first and second ends, said first end defining together with said wall means a first compression chamber and a first combustion chamber, said second end defining together with said projecting wall means portion a second compression chamber, and a second combustion chamber, said chambers contracting and expanding during reciprocation of said piston means;

a piston rod attached to said piston and extending external to said cylinder means through said cavity;

carburetion means associated with said cylinder means for introducing fuel into each of said first and second compression chambers;

ignition means associated with said cylinder for igniting said fuel in said first and second compression chambers; and means for exhausting gases from said first and second combustion chambers, after fuel ignition in said first and second compression chambers in alternating fashion.

In the preferred embodiment, the inventive two-stroke engine is constructed as a cylinder having a reciprocating piston slidably seated therein, with the piston shaped on one end thereof with a central borehole partially extending therethrough. One end of the cylinder wall has a sleeve-shaped portion which extends longitudinally within the center of the cylinder interior volume, and this cylinder wall portion extends into the piston borehole, so that it slidingly engages the piston as it reciprocates. A compression and combustion chamber is thus defined between the cylinder wall and each side of the piston, and with appropriate fuel introduction, ignition and gas exhaust systems, the two-stroke engine can provide work in bi-directional fashion from the two combustion chambers acting in phase. A piston rod extending through the tubular-shaped wall portion enables the useful work output of the engine to be harnessed.

In this embodiment, the piston rod is provided with reciprocating linear motion, and a mechanical converter is used to change the linear movement to rotational motion providing torque from which rotational power can be extracted for machinery.

In an alternative embodiment, the cylinder is shaped with a bottom portion which is split into two sections, in which a bifurcated piston is seated in reciprocating fashion. A piston rod extends through the space between the split cylinder sections, and is driven with conventional side-to-side linear motion, so that by connection to a conventional offset crankshaft, the useful work output of the engine is harnessed.

The inventive two-stroke engine is compact in size and more powerful than a similar 4 or 2-cycle engine, since its dual action makes it equivalent to two combined standard engines.

The inventive engine also provides a reduction in overall weight, and decreases the weight-to-power ratio. An increase in the fuel efficiency is also achieved. Recoil impulses from the torque produced are reduced, increasing the engine life.

As will be appreciated from the following description, the engine design of the present invention improves the existing designs without requiring radical departures from current practice and will therefore be easily adaptable to today's machinery, with little redesigning involved.

With appropriate modifications, the inventive engine can also be operated as a one cycle engine. It is also capable of operation as a Diesel engine, affording significant fuel savings.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE PREFERRED EMBODIMENTS

Figure 1:
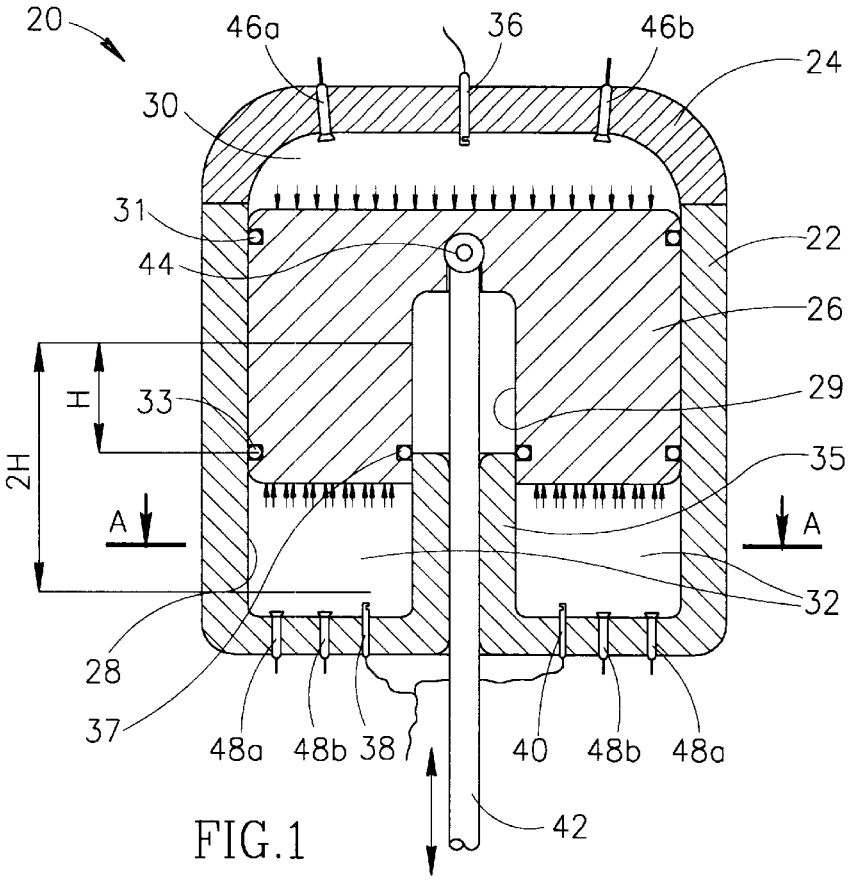
FIG. 1 is a cross-sectional side elevation view of a preferred embodiment of a two-stroke internal combustion engine constructed and operated in accordance with the present invention.

Referring now to FIG. 1, there is shown a cross-sectional side elevation view of a preferred embodiment of a three cycle, two-stroke internal combustion engine 20 constructed and operated in accordance with the present invention. Engine 20 comprises a cylinder 22 having cylinder head 24 attached by screws 23, with cylinder 22 enclosing a piston 26 slidingly seated and sealed against interior cylinder walls 28 for reciprocating motion within cylinder 22. Piston 26 is shaped with a truncated borehole 29 extending for a fixed length therein, and defines a pair of compression and combustion chambers 30, 32 opposite the upper and lower ends of piston 26. A portion of walls 28 shaped as a sleeve 35 projects centrally within the cylinder volume, making chamber 32 toroidally-shaped.

Piston 26 is sealed within cylinder 22 by sealing rings 31, 33 and 37, designed to allow sealed, sliding piston motion.

In combustion chamber 30 there is positioned a spark plug 36, and in combustion chamber 32, a pair of spark plugs 38, 40, since sleeve 35 partially occludes one spark plug from the main volume of the combustion chamber, and the extra spark plug insures good ignition.

A piston rod 42 extends via borehole 29 formed in sleeve 35 and is connected via connector 43 to a crossbar 44 seated within piston 26 (see FIG. 4) so as to move with the motion of piston 26.

The fuel system of engine 20 is arranged such that an air-fuel mixture is injected into combustion chamber 30 via injection valve 46*a*, and the air-fuel mixture is injected into combustion chamber 32 via injection valves 48*a*. A corresponding set of exhaust valves 46*b* and 48*b* are provided for gas exhaust.

Figure 2A:
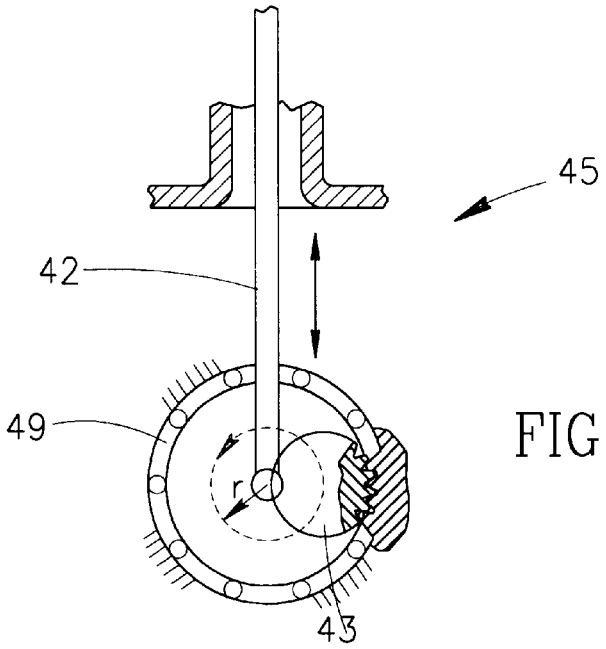
FIGS. 2*a–b* are illustrations of a linear to rotary converter device for use with the engine of FIG. 1.
Figure 2B:
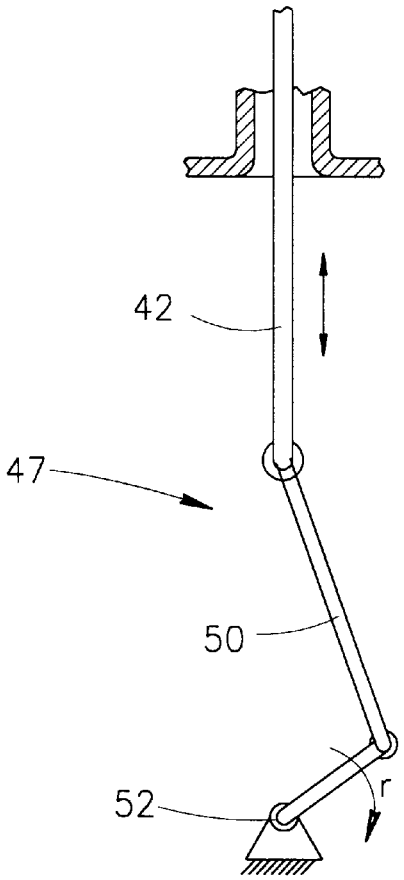

In accordance with the principles of the present invention, engine 20 generates reciprocating linear motion in piston rod 42. FIGS. 2*a–b* each illustrate a linear-to-rotary motion converter. The motion converter 45 of FIG. 2*a* is described in a patent application to Kaplonovsky, Israel Patent No. 103959, and operates with an inner circular toothed element 43 engaging an outer circular toothed element 49 to provide rotation. FIG. 2*b* shows a standard type motion converter 47, in which a linkage 50 causes rotation of a rod with radius R about point 52.

Figure 3:
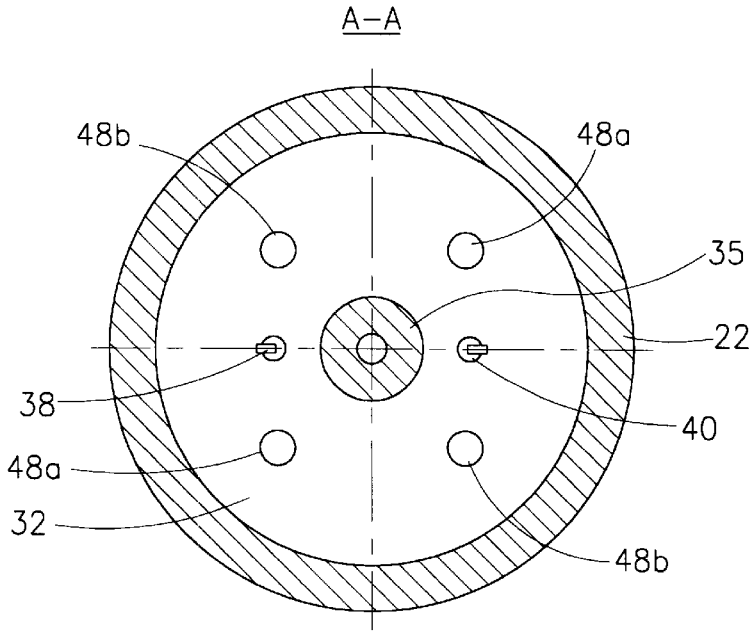
FIG. 3 is a top cross-sectional view of the engine of FIG. 1 taken along section lines A—A.

In FIG. 3, there is shown a top cross-sectional view of the engine of FIG. 1 taken along section lines A—A, revealing the layout of spark plugs 38 and fuel injection and exhaust valves 46*a–b*, 48*a–b*. The circular shape of sleeve 35 is also shown.

It will be appreciated by those skilled in the art that the circular shape of sleeve 35 may be modified to be rectangular with appropriate modifications of the cylinder walls, etc.

Figure 4:
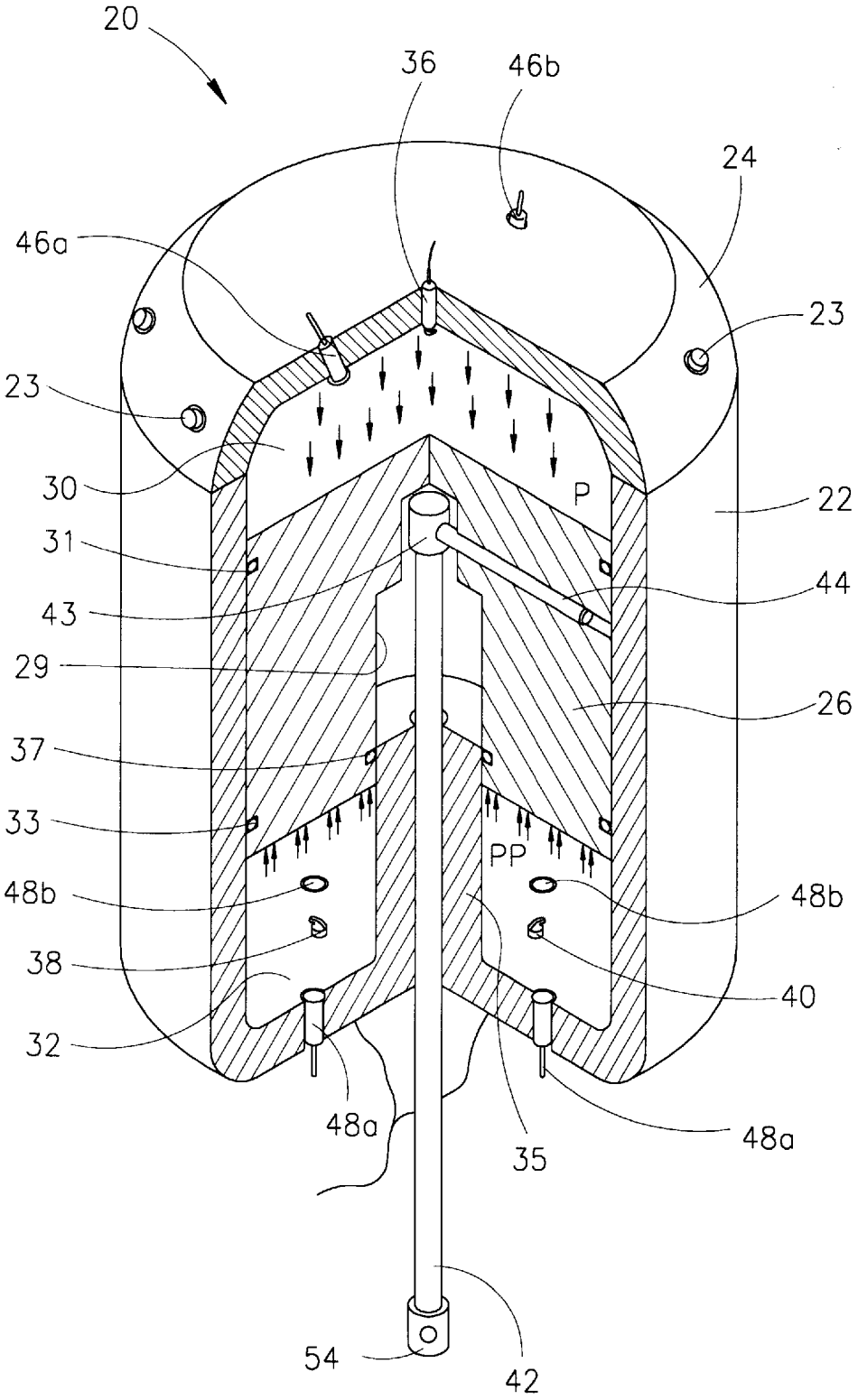
FIG. 4 is a partial cutaway perspective view of the engine of FIG. 1.

FIG. 4 is a partial cutaway perspective view of the engine of FIG. 1, illustrating the operation of engine 20.

Figure 5:
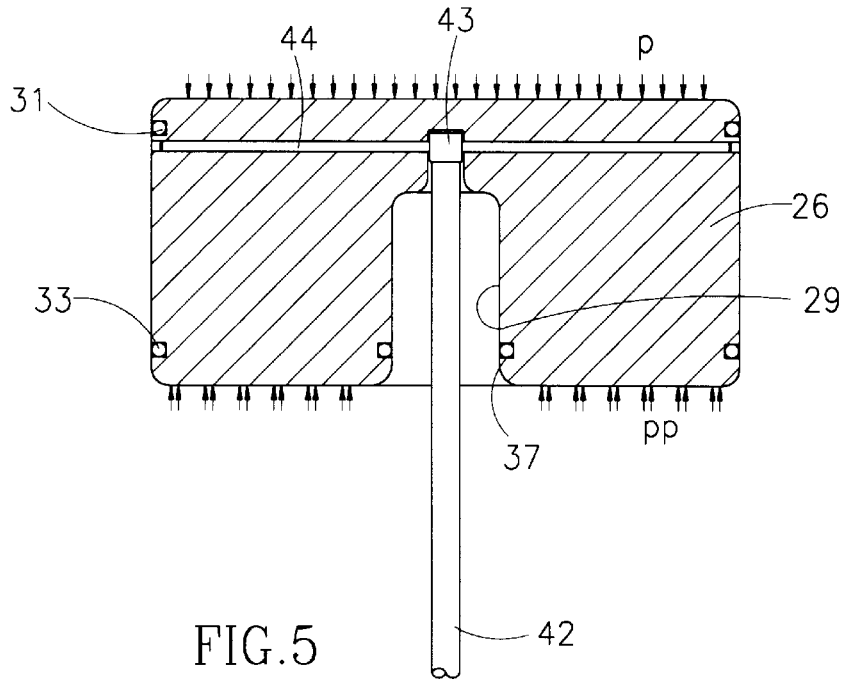
FIGS. 5–6 are, respectively, cross-sectional side elevation and perspective views of a piston operating in FIG. 1.
Figure 6:
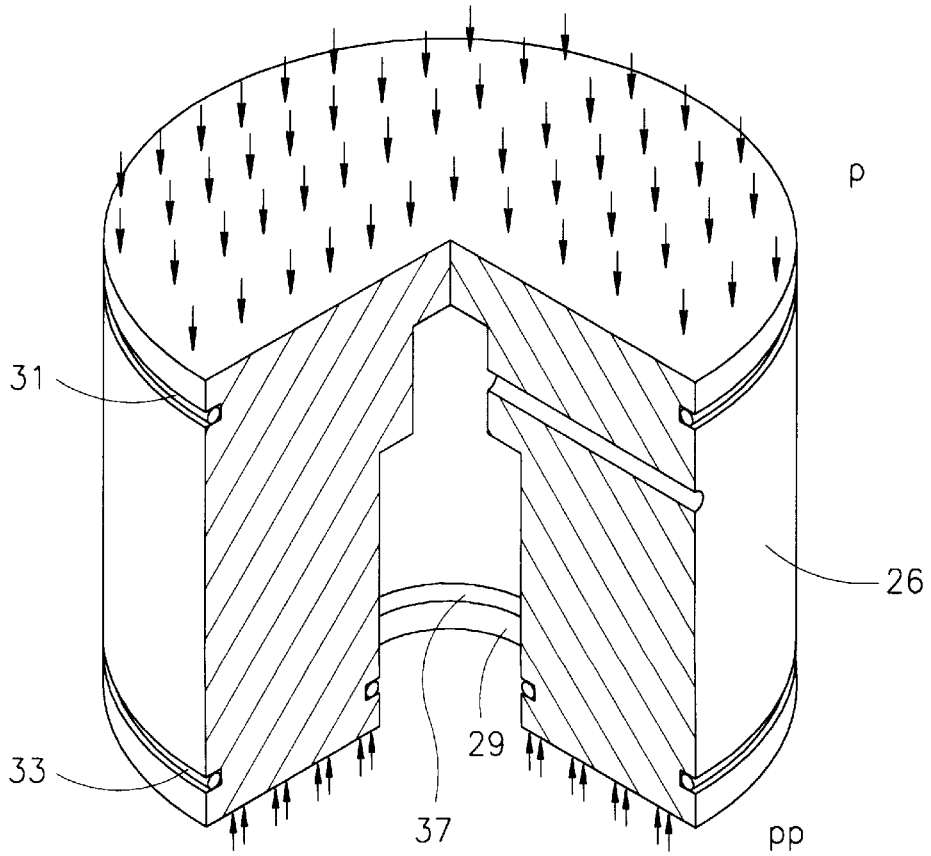

FIGS. 5–6 are, respectively, cross-sectional side elevation and perspective views of a piston operating in FIG. 1.

In operation, each of combustion chambers 30, 32 is fed with fuel in alternate phases, never simultaneously. Burning of the fuel in the two combustion chambers 30, 32 occurs synchronously with movement of piston 26, in alternation between them. Pressure P develops against the top of piston 26 when chamber 30 is in a combustion mode, and pressure PP develops against the lower part of piston 26 when chamber 32 is in a combustion mode.

As a result of the alternate combustion in chambers 30, 32, piston rod 42 moves up and down linearly within sleeve 35. Useful work is derived from the output of engine 20 and is transferred via connector 54 to one of motion converters 45, 47. The motion converter changes the linear movement of piston rod 42 to rotary motion, which provides torque from which the work can be extracted for useful applications, including vehicle motion.

The length of the work cycle associated with engine 20 is indicated by the dimension H, and the piston rod 42 length is therefore 2H. Thus, the cylinder has a length greater than that of a conventional type engine, but this is not a major problem.

Figure 7:
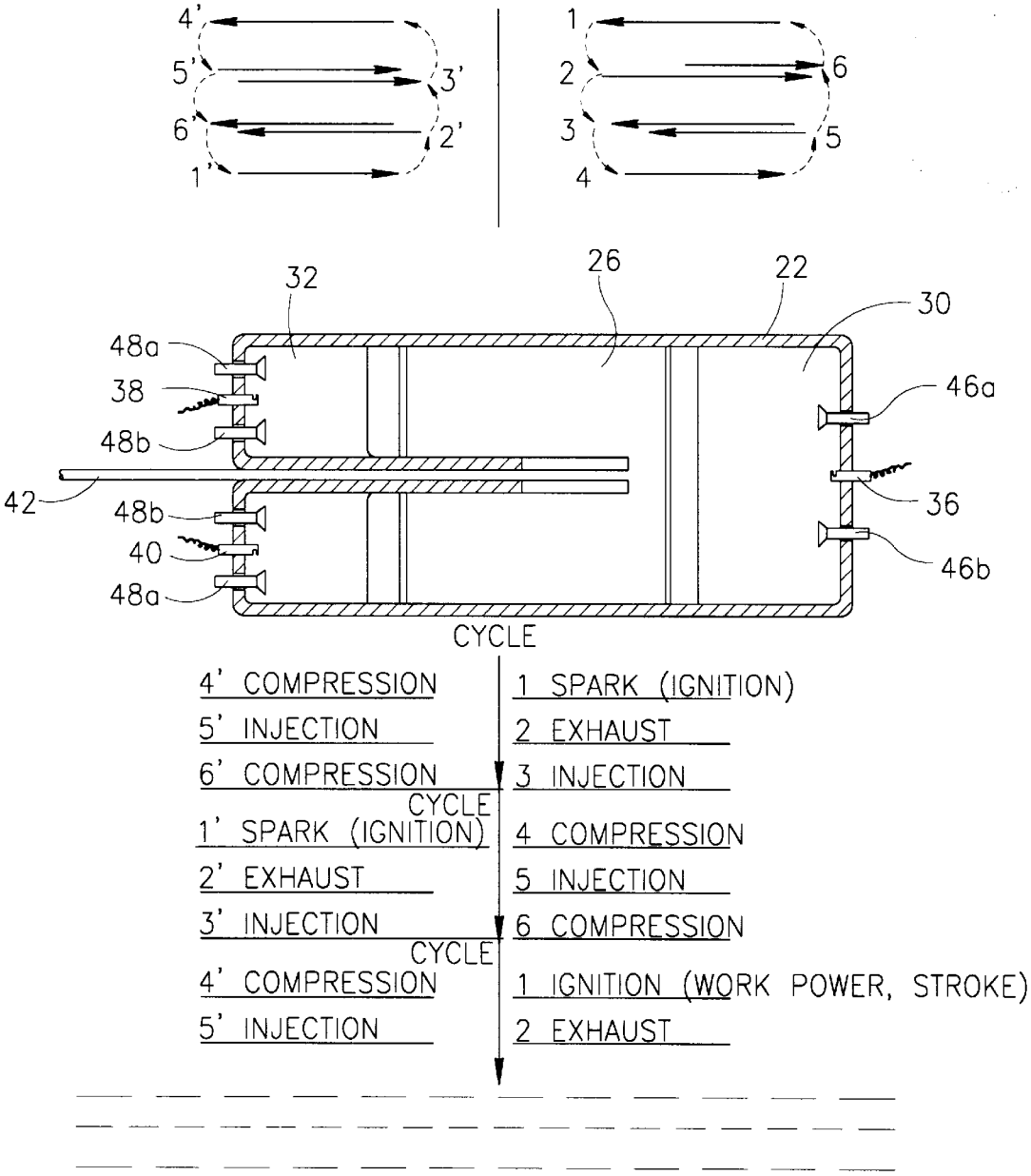
FIG. 7 is an illustration of a three cycle operation of the engine of FIGS. 1–6.

Referring now to FIG. 7, there is illustrated a three cycle operation of engine 20. The stages of operation in a given chamber are labeled (1) ignition, (2) exhaust, (3) injection, (4) compression, (5) injection, and compression (6), and then the cycle begins again in that chamber. The opposing chamber has its operational cycle shifted so that three stages constitute a cycle. The operational sequence is indicated by the arrows showing the direction of piston 26 movement and the list indicating the stage. The terminology "three cycle" thus describes a three-stage cycle.

The three cycle operation enables much more efficient and complete filling of the chambers with air-fuel mixture for combustion, since there are two injection and compression stages for each chamber before ignition takes place. This increases the engine efficiency and derives maximum power from its operation. It also decreases pollution which has positive ecological effects.

Figure 8:
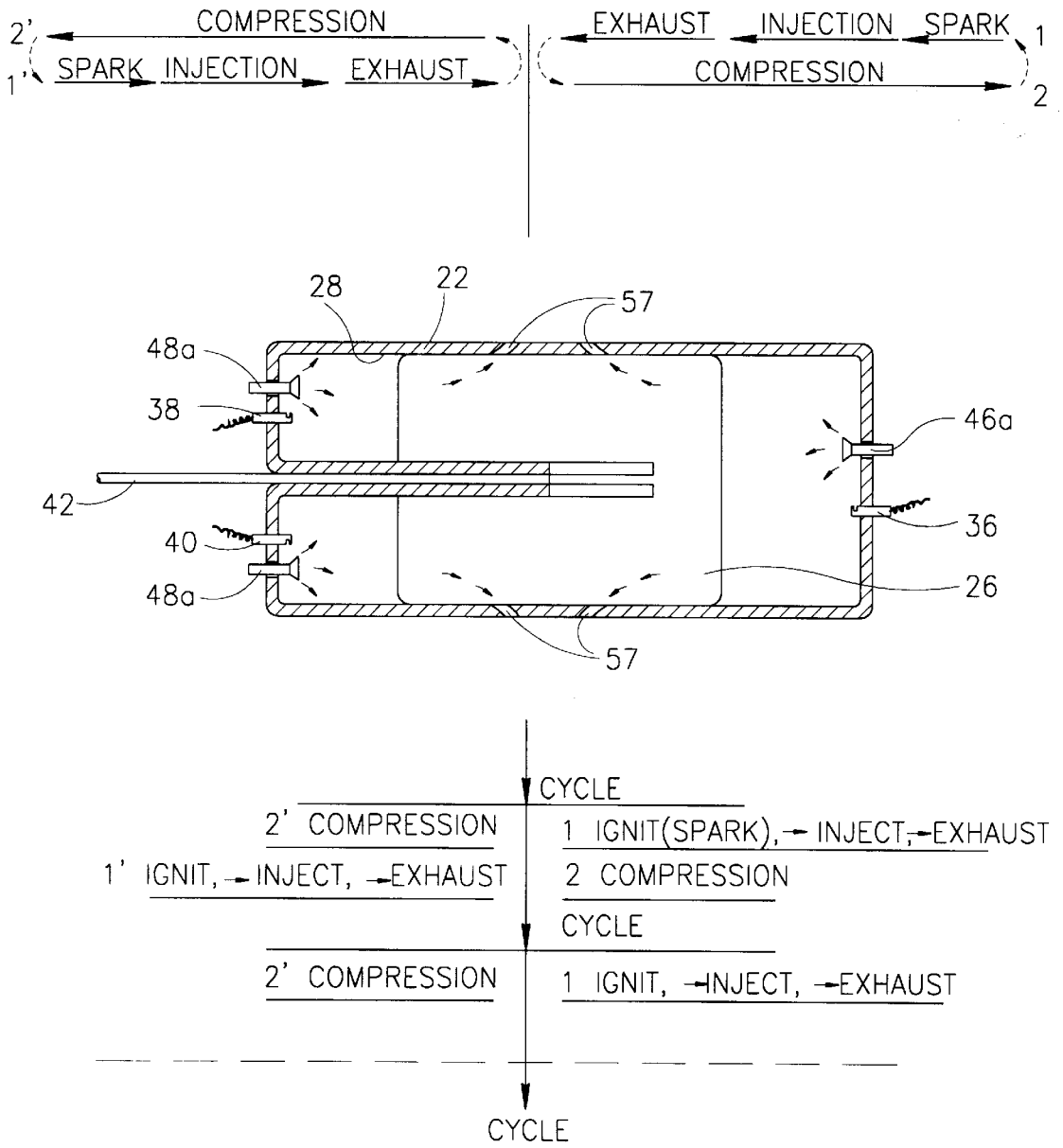
FIG. 8 is an illustration of a one cycle operation of a modified construction of the engine of FIGS. 1–6.

In FIG. 8, there is illustrated a one cycle operation of engine 20. In this design, the engine is modified with the provision of exhaust valves 57 in cylinder walls 28 along the length of cylinder 22. The stages of operation in a given chamber are labeled (1) ignition and (2) compression, and then the cycle begins again in that chamber. The opposing chamber has its operational cycle shifted so that two stages constitute a cycle. The operational sequence is indicated by the arrows showing the direction of piston 26 movement and the list indicating the stage.

Advantages of the inventive two-stroke engine design include a reduction in overall weight of the engine needed to provide a given rate of work (power). The weight-to-power ratio of this new engine design is estimated to be on the order of 0.4.–0.5 kg/hp, or even better if Kaplonovsky-type converters are used. The engine efficiency, in particular the fuel efficiency, is increased, and the new type of converter enhances the increase.

The inventive engine also achieves a reduction in the "recoil" impulses from the torque produced, resulting in a longer work cycle and a longer working life for the engine.

Since the engine works in two directions, the "boxer' configuration of the standard internal combustion engine is unecessary, and a single piston is sufficient. Although the work cycle of the single piston is somewhat longer than that used by the "boxer" design using two pistons, the reduced overall weight and increased compactness of the inventive engine, for the same output, are material advantages and outweigh the slight increase in the duration of the work cycle.

The production technology for manufacturing the cylinder body is slightly more expensive than that for standard cylinders. However, since the actual (completed) engine is smaller for a given output than a standard engine and has less internal parts, the overall engine production cost is competitive.

Figure 9:
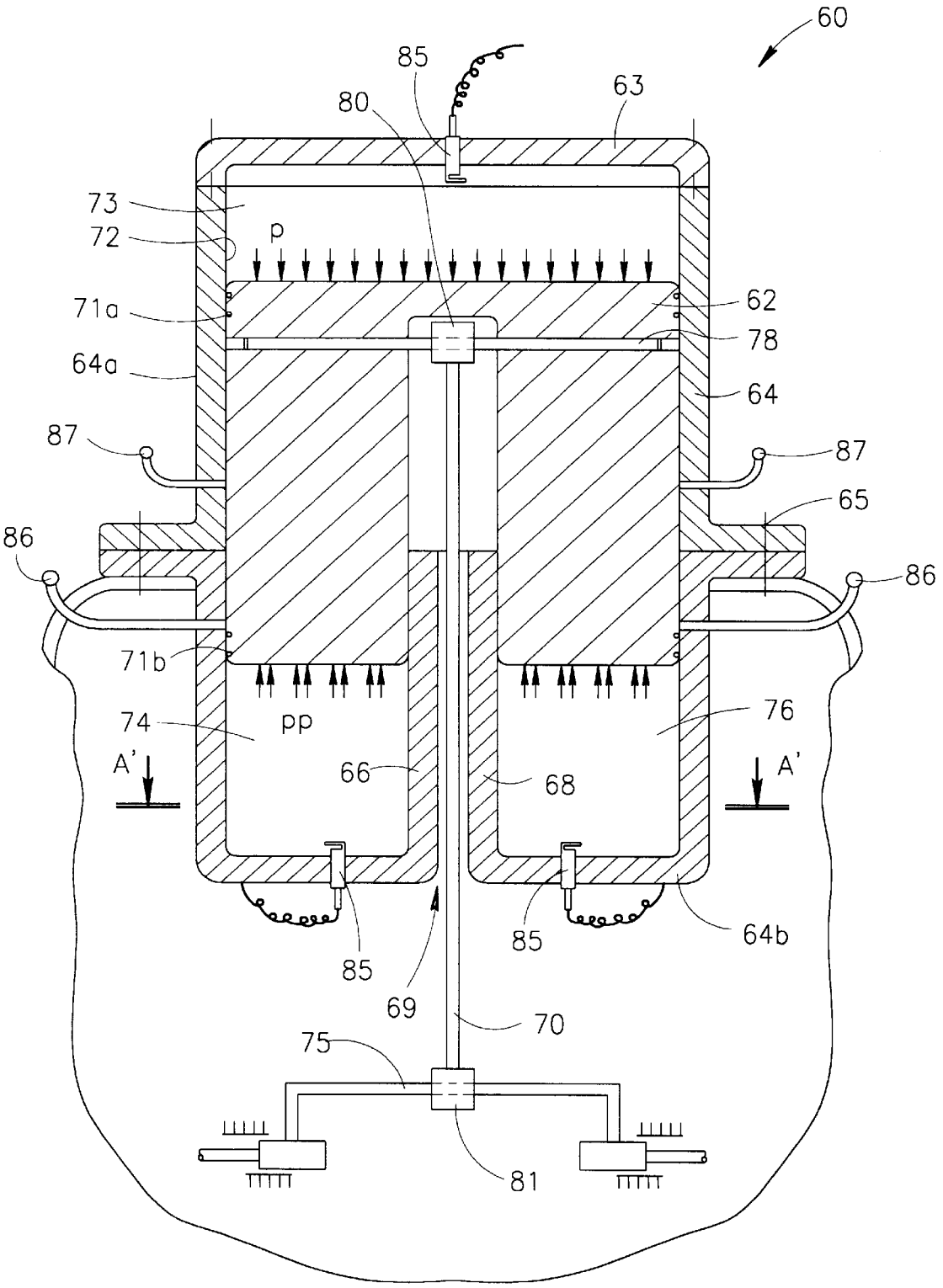
FIG. 9 is a cross-sectional side elevation view of an alternative embodiment of a two-stroke internal combustion engine, featuring a bifurcated piston in a split cylinder.

FIGS. 9–13 illustrate an alternative embodiment of the two-stroke internal combustion engine 60 in accordance with the principles of the present invention. FIG. 9 is a cross-sectional side elevation view of the alternative embodiment, featuring a bifurcated piston 62 in a split cylinder 64. Cylinder 64 comprises head 63, upper and lower halves 64*a–b*, bolted together at point 65.

Figure 11:
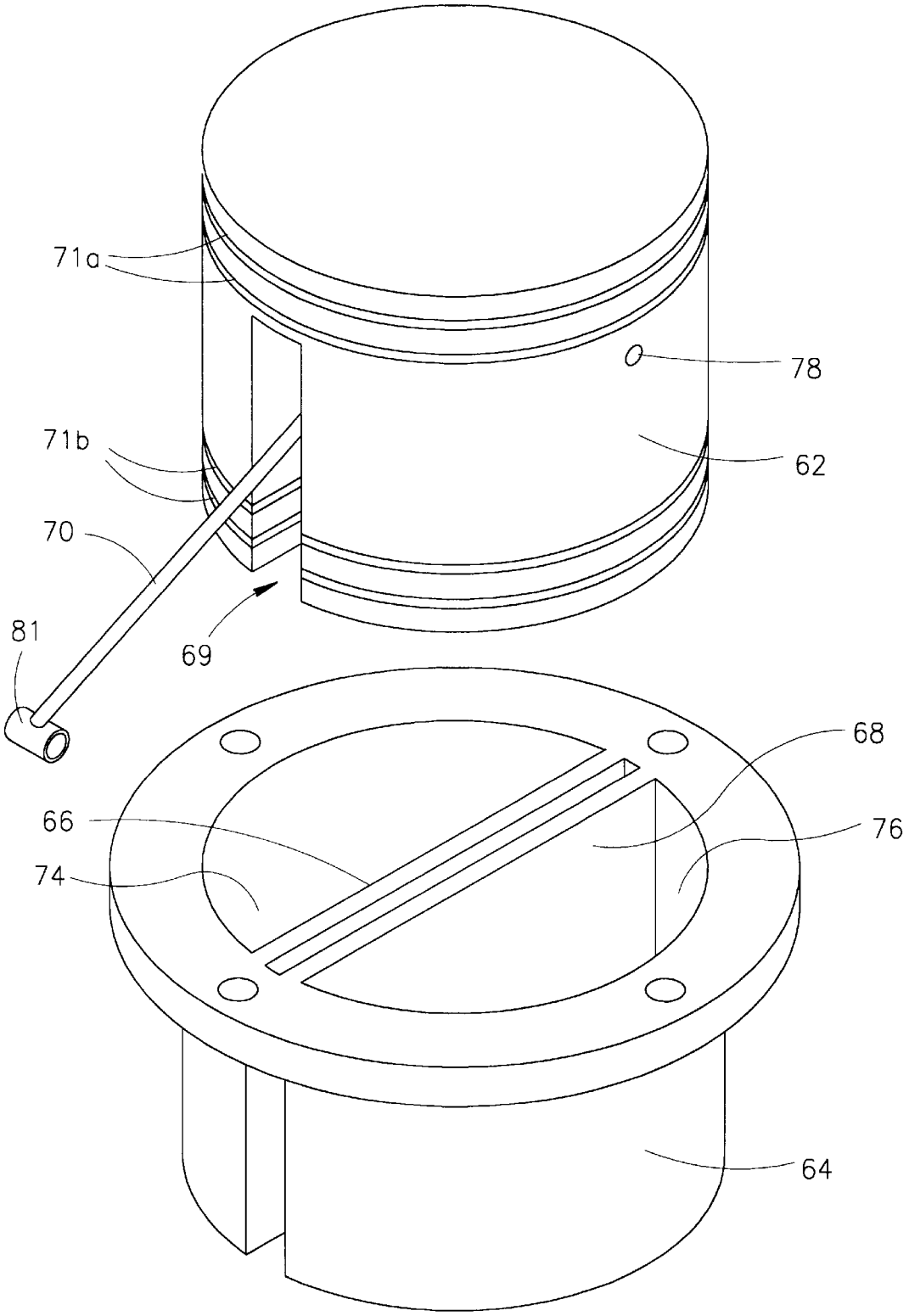
FIG. 11 is an exploded perspective view of the FIG. 9 embodiment showing the bifurcated piston and split cylinder.
Figure 13:
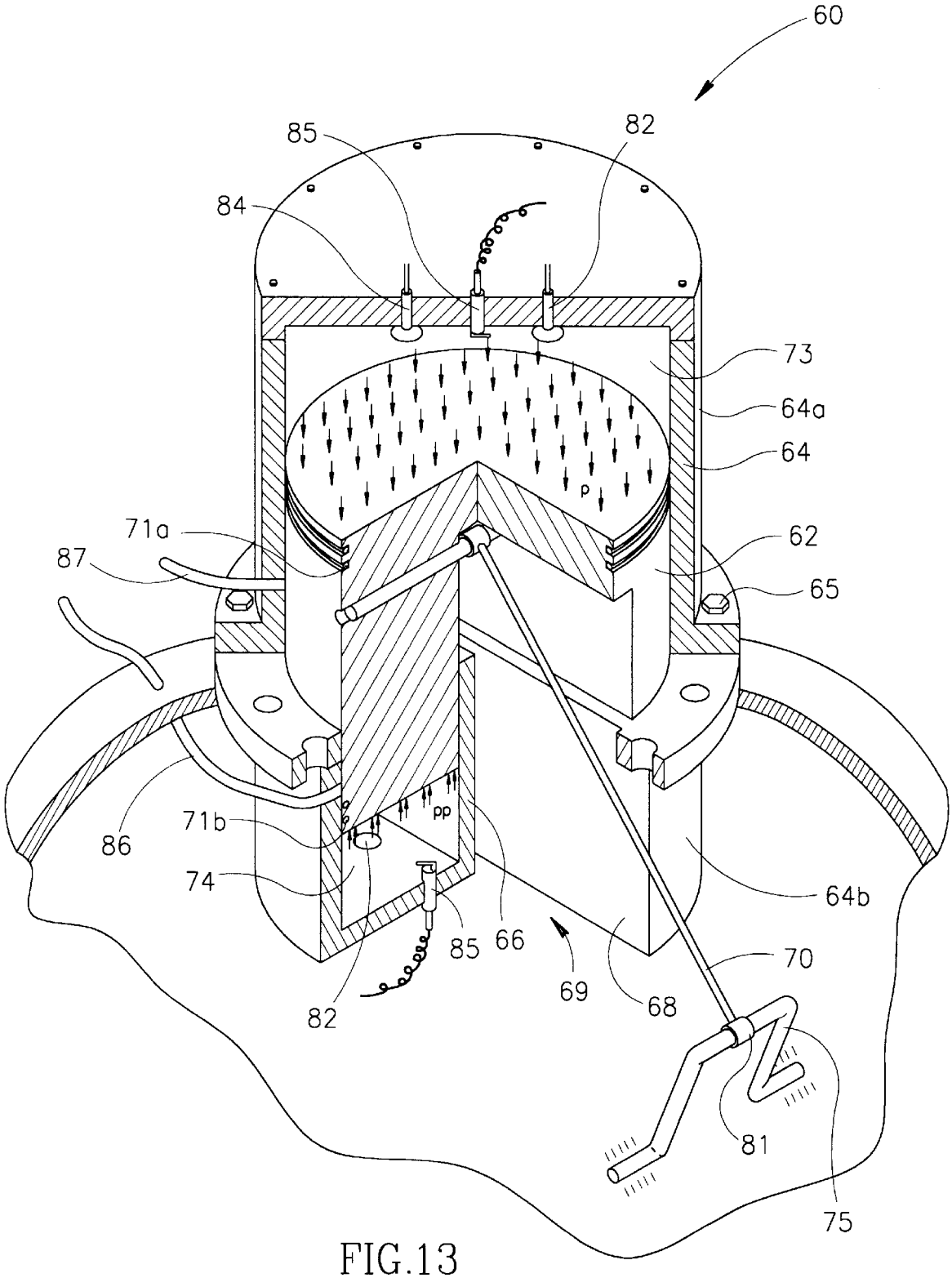
FIG. 13 is a perspective view of the FIG. 9 embodiment.

In this embodiment, as better seen in FIGS. 11 and 13, cylinder 64 is split in its mid-section and is shaped with a pair of internal walls 66, 68 having a width equivalent to the cylinder diameter. Walls 66, 68 define a rectangular cavity 69 therebetween within which a piston rod 70 moves with side-to-side reciprocating motion developed by motion of bifurcated piston 62 in split cylinder 64. A set of piston rings 71*a–b* seals the gap between piston 62 and the interior cylinder walls 72.

Three fully separate combustion chambers are defined by this construction, upper combustion chamber 73 and two lower combustion chambers 74, 76, each of which has a substantially semi-circular shape. Piston rod 70 is connected to a crossbar 78 via a rotational coupling 80, to enable side-to-side piston rod 70 motion which is converted into rotational motion via rotational coupling 81 on a standard converter provided by a conventional crankshaft 75, turning in an oil bath (not shown).

Figure 10:
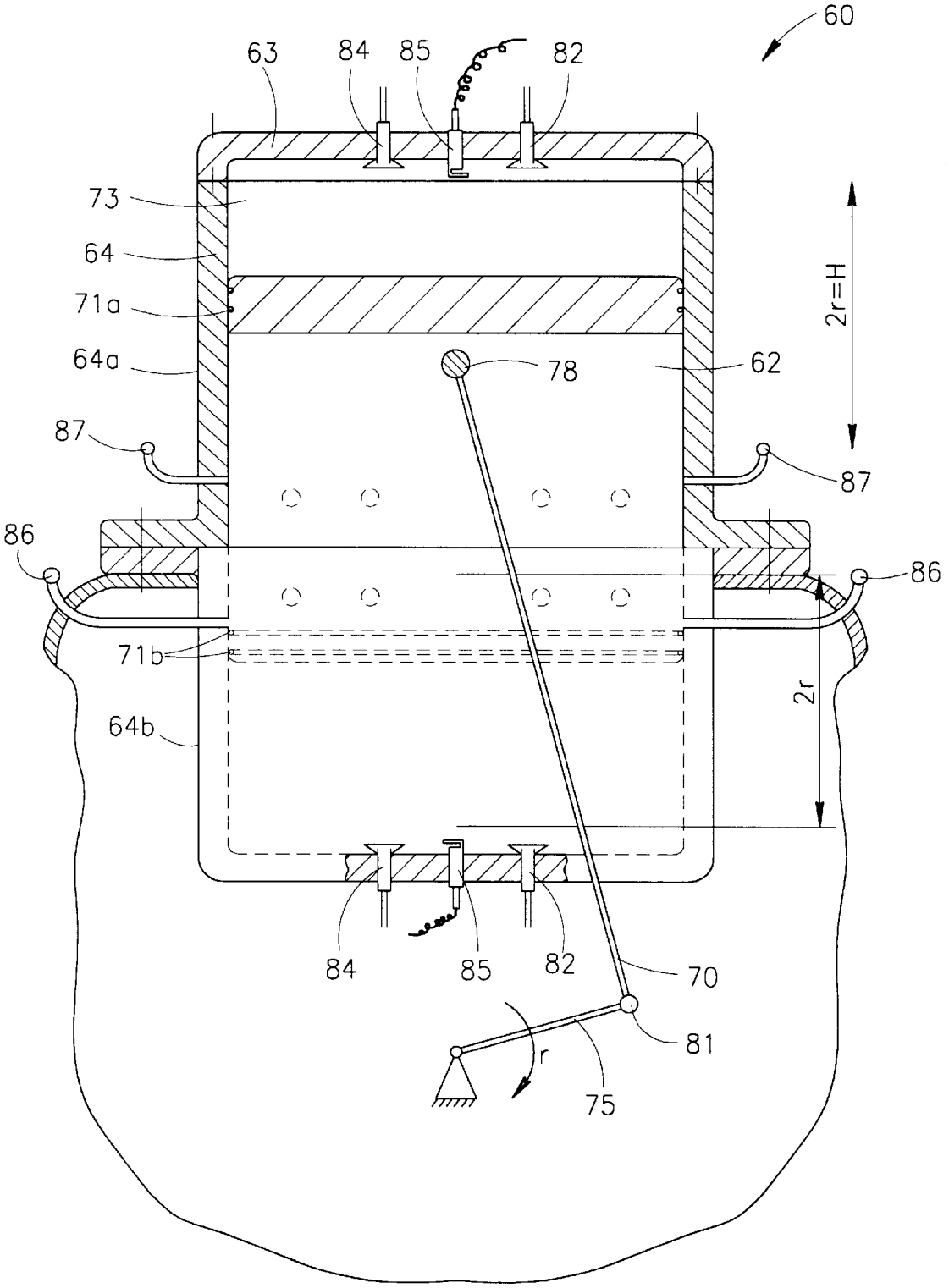
FIG. 10 is a partial cutaway side view of the FIG. 9 embodiment rotated ninety degrees about the central axis.

In FIG. 10, a partial cutaway side view of the FIG. 9 embodiment is shown rotated ninety degrees about the central axis, revealing further construction detail. In a three cycle application, engine 60 is constructed with fuel system components including injection valves 82, and exhaust valve 84 on both upper and lower halves 64*a–b* of cylinder 64 and spark plugs 85. When used in a one cycle application, engine 60 is modified so that two pairs of exhaust valves 86, 87 are provided instead of exhaust valves 84 to remove gases from chambers 73, 74 and 76.

In FIG. 11, an exploded perspective view of the FIG. 9 embodiment is shown, featuring the bifurcated piston 62 and split cylinder 64. The semi-circular shape of the lower combustion chambers 74, 76 is shown. Rectangular cavity 69 is also shown.

Figure 12:
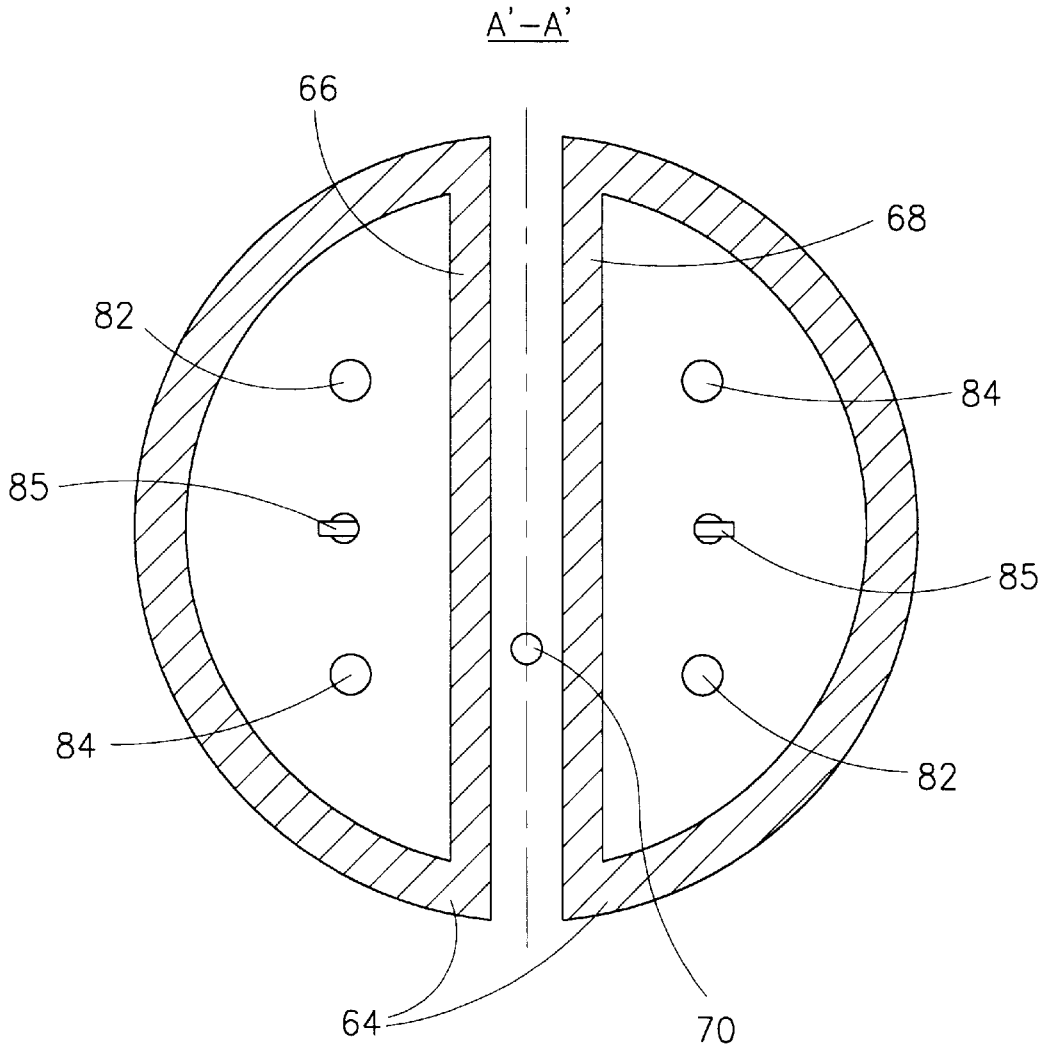
FIG. 12 is a cross-sectional top view of the split cylinder of FIG. 11, taken along section lines A'—A' of FIG. 9.

In FIG. 12, a cross-sectional top view of the split cylinder of FIG. 11 is shown, taken along section lines A'—A' of FIG. 9. FIG. 13 is a perspective view of the FIG. 9 embodiment.

In operation, each of combustion chambers 73, 74 and 76 is fed with fuel in alternate phases, never simultaneously. Burning of the fuel in the lower two combustion chambers 74, 76 occurs synchronously with movement of piston 62, in alternation between them. Pressure P develops against the top of piston 62 when chamber 73 is in a combustion mode, and pressure PP develops against the lower part of piston 62 when chambers 74, 76 are in a combustion mode. The piston 62 slides against the interior cylinder wall 72, and piston rings 71*a–b* insure that constant contact between them minimizes the chance of fuel leakage or formation of bubbles (areas of vacuum or pressure gradient). Piston 62 is entirely enclosed, as in conventional combustion engines, as contrasted with the prior art designs to Barnwell and Stelzer described in the Background, having partially exposed piston rods.

As a result of the alternate combustion in chambers 73–76, piston rod 70 moves with reciprocating side-to-side motion within cylinder 64. Useful work is derived from the output of engine 60 and is transferred via coupling 81 to crankshaft 75, which converts linear movement of piston rod 70 to rotary motion, providing torque from which the work can be extracted for useful applications, including vehicle motion.

In summary, the inventive two-stroke engine design provides a lightweight, compact and more powerful engine without requiring radical departures from current practice, enabling it to be easily adaptable to today's machinery, with little redesigning involved. Lower pollution provides ecological benefits.

Having described the invention with regard to certain specific embodiments, it is to be understood that the description is not meant as a limitation, since further modifications may now become apparent to those skilled in the art, and it is intended to cover such modifications as fall within the scope of the appended claims.

I claim:

1. A three cycle, two-stroke internal combustion engine comprising:

a cylinder means having interior volume defined by wall means having a portion thereof projecting longitudinally from one end of said cylinder mean into said interior volume, defining a cavity which opens externally of said cylinder means proximate said wall means portion;

a piston means slidable in reciprocating fashion and sealed within said cylinder means and having first and second ends, said first end defining together with said wall means a first compression chamber and a first combustion chamber, said second end defining together with said projecting wall means portion a second compression chamber, and a second combustion chamber, said chambers contracting and expanding during reciprocation of said piston means;

a piston rod attached to said piston and extending externally of said cylinder means through said cavity;

carburetion means associated with said cylinder means for introducing fuel into each of said first and second compression chambers;

ignition means associated with said cylinder for igniting said fuel in said first and second compression chambers; and means for exhausting gases from said first and second combustion chambers, after fuel ignition in said first and second compression chambers in alternating fashion.

2. The engine of claim 1 wherein said projecting wall means portion comprises a sleeve centrally projecting for a fixed length into said cylinder interior volume.

3. The engine of claim 2 wherein said second end of said piston is formed with a truncated central borehole extending within said piston for said fixed length, said sleeve extending within said borehole to define said second compression chamber and second combustion chamber with a toroidal shape around said centrally projecting sleeve.

4. The engine of claim 3 wherein piston has a set of sealing rings seated around its outer circumference, and a set of sealing rings seated within said central borehole.

5. The engine of claim 3 wherein said piston rod is provided with reciprocating linear motion and extends through said central borehole and said sleeve into said external cavity.

6. The engine of claim 5 further comprising a linear-to-rotary motion converter connected to said piston rod.

7. The engine of claim 1 wherein said projecting wall means portion comprises a pair of substantially parallel internal walls forming a split in a portion of the length of said cylinder, defining a pair of substantially semi-circular shaped chambers.

8. The engine of claim 7 wherein said second end of said piston is bifurcated and insertable into said semi-circular shaped chambers forming said second compression chamber and said second combustion chamber.

9. The engine of claim 8 wherein said piston has a set of circular sealing rings seated on an upper portion thereof, and a set of semi-circular sealing rings seated on each bifurcated end.

10. The engine of claim 7 wherein said piston rod is provided with side-to-side reciprocating linear motion and extends through said split cylinder portion into said external cavity.

11. The engine of claim 10 further comprising a crankshaft linear-to-rotary motion converter connected to said piston rod.

12. The engine of claim 1 wherein piston is sealed within said cylinder during the entire length of its reciprocating motion therein.

13. The engine of claim 1 wherein said ignition means comprises a pair of spark plugs in one of said first and second compression chambers, on opposite sides of said projecting wall.

14. A method of operating a three cycle, two-stroke internal combustion engine comprising the steps of:

providing an engine according to claim 1 having said first and second chambers; and operating said engine in a cycle in which one of said first and second chambers operates sequentially in (1) ignition, (2) exhaust, (3) injection, stages, simultaneous with operation of said other chamber in (4) compression, (5) injection, and compression (6) stages, and repeating said cycle again by beginning with said ignition stage in said other chamber.

15. The method of claim 14 wherein each chamber has two injection and two compression stages before ignition, providing improved filling of air-fuel mixture in each chamber and improved combustion efficiency.

16. A method of operating a one cycle, two-stroke internal combustion engine comprising the steps of:

providing an engine according to claim 1 having said first and second chambers; and operating said engine in a cycle in which one of said first and second chambers operates sequentially in (1) ignition, (2) injection and (3) exhaust stages simultaneous with operation of said other chamber in (4) a compression stage, and repeating said cycle again by beginning with said ignition stage in said other chamber.

* * * * *